US006215956B1

(12) United States Patent
Lee

(10) Patent No.: US 6,215,956 B1
(45) Date of Patent: Apr. 10, 2001

(54) RECIPROCATING RADIANT ELECTRIC HEATER

(75) Inventor: Jang Bum Lee, Seoul (KR)

(73) Assignee: Gana Multi-Technology Co. Ltd., Gumi (KR)

( * ) Notice: Subject to any disclaimer, the term of this patent is extended or adjusted under 35 U.S.C. 154(b) by 0 days.

(21) Appl. No.: 09/564,139

(22) Filed: May 3, 2000

(30) Foreign Application Priority Data

Jun. 15, 1999 (KR) ..... 99-10602

(51) Int. Cl.[7] ..... H05B 3/00

(52) U.S. Cl. ..... 392/440; 392/376; 392/373; 392/426; 74/25

(58) Field of Search ..... 392/373, 374, 392/375, 376, 366, 422, 426–429, 440; 416/110, 247 R, 164, 100; 415/126; 74/25, 69

(56) References Cited

U.S. PATENT DOCUMENTS

| | | | | |
|---|---|---|---|---|
| 1,440,171 | * | 12/1922 | Papini | 392/440 |
| 3,228,260 | * | 1/1966 | Braskamp | 416/100 |
| 3,377,465 | * | 4/1968 | Ronk | 392/373 |
| 3,482,077 | * | 12/1969 | Kleinman | 416/100 |
| 5,411,371 | * | 5/1995 | Chen | 416/100 |

FOREIGN PATENT DOCUMENTS

| | | | | |
|---|---|---|---|---|
| 261062 | * | 10/1988 | (DE) | 416/100 |
| 544873 | * | 10/1922 | (FR) | 392/440 |
| 589098 | * | 5/1925 | (FR) | 392/440 |
| 867253 | * | 5/1961 | (GB) | 392/440 |
| 1-267394 | * | 10/1989 | (JP) . | |
| 5-288189 | * | 11/1993 | (JP) . | |
| 6-173887 | * | 6/1994 | (JP) . | |
| 98-61527 | | 11/1998 | (KR) . | |

* cited by examiner

*Primary Examiner*—John A. Jeffery
(74) *Attorney, Agent, or Firm*—Merchant & Gould P.C.

(57) ABSTRACT

An electric heater with a post and a heating member; which comprises an orientation device comprising a pole or spindle fixed on the post; a movable plate formed with front and rear holes and rotatably mounted on the pole or spindle through its front hole, carrying the heating member; a geared motor with a shaft extending downwardly through the rear hole of the movable plate; a transmission plate formed with mating teeth on the upper surface and rotatably fixed to the lower end of the motor shaft; a driving plate carrying a guide pin on or near its lower edge and formed with mating teeth on its bottom surface to be engaged with the counter part of the transmission plate; a spring mounted around the motor shaft under the movable plate for elastically pressing the driving plate downwardly; and an elongate guide path formed on the post for receiving the guide pin and allowing it to reciprocate straightly therein, for automatically and easily converting the direction of heat reflection of the reflector is disclosed.

3 Claims, 9 Drawing Sheets

RECIPROCATING RADIANT ELECTRIC HEATER

BACKGROUND OF THE INVENTION

1. Field of the Invention

The present invention relates to an electric heater generally used for heating a space in a building, and more particularly, to an improvement to the electric heater of the Korean Utility Model Application No. 1997-5769 of the same inventor as that of the present invention.

2. Description of the Prior Art

An electric heater disclosed in the Korean Utility Model Appln. No. 97-5769 is designed to radiate heat generated from an electric heating wire a long way off by using a spherical reflector (for example, a parabolic type), thereby obtaining an optimal energy efficiency.

The reflector of the electric heater, however, is permanently fastened at a post on a stand and thus a user must reach or get to the heater and manually change the direction to which the reflector faces, whenever the user wants to change the direction of the heat radiation.

Moreover, the heater could hardly warn a room or space uniformly in a short period of time, if it were left to radiate heat only in one direction.

SUMMARY OF THE INVENTION

It is an object of this invention to provide an electric heater which can warm a space uniformly in a relatively short period of time.

Another object of this invention is to provide an electric heater which is very convenient and simple to use.

The above objects can be accomplished by providing an electric heater which can alternately change the lateral direction of the heat radiation from left to right and then from right to left by means of a reflector rotating device.

The present invention provides an electric heater with a post and a heating member; which comprises an orientation device comprising a pole or spindle fixed on the post; a movable plate formed with front and rear holes and rotatably mounted on the pole or spindle through the front hole, carrying the heating member; a geared motor with a shaft extending downwardly through the rear hole of the movable plate; a transmission plate formed with mating teeth on the upper surface and rotatably fixed to the lower end of the motor shaft; a driving plate carrying a guide pin on or near its lower edge and formed with mating teeth in a groove on its bottom surface to be engaged with the counter part of the transmission plate; a spring mounted around the motor shaft under the movable plate for elastically pressing the driving plate downwardly; and an elongate guide path formed on the post for receiving the guide pin obliquely relative to the pole or spindle and allowing it to reciprocate straightly therein.

Therefore, when a user turns on a switch of the rotating device, the reflector performs a continuous reciprocating motion in an adequate speed within the range of the predetermined angle, thereby radiating heat generated from the heating wire uniformly within a room or space to be heated or warmed.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENT

Figure 1:
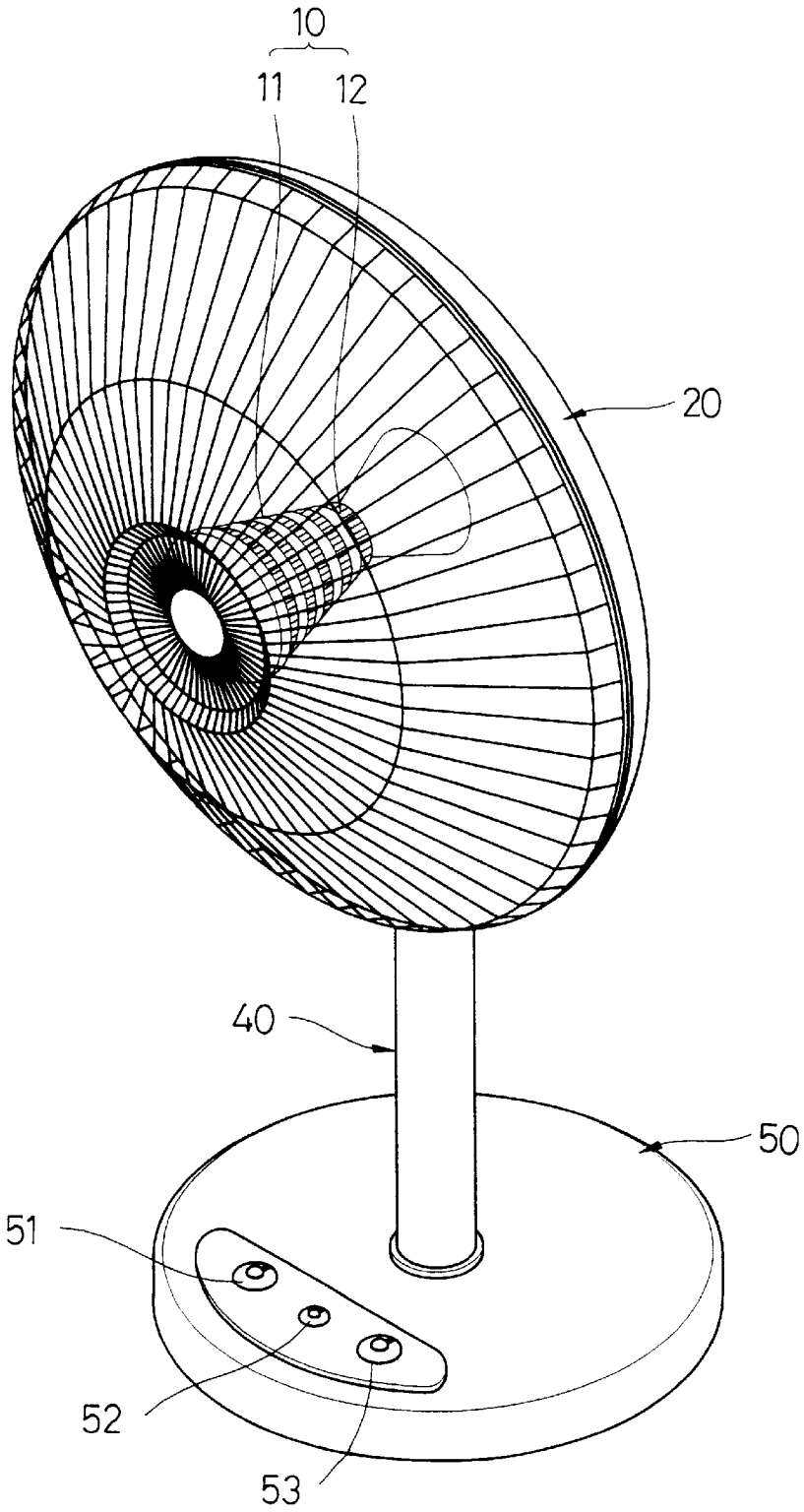
FIG. 1 is a perspective view of an electric heater to which the present invention is applied.
Figure 2:
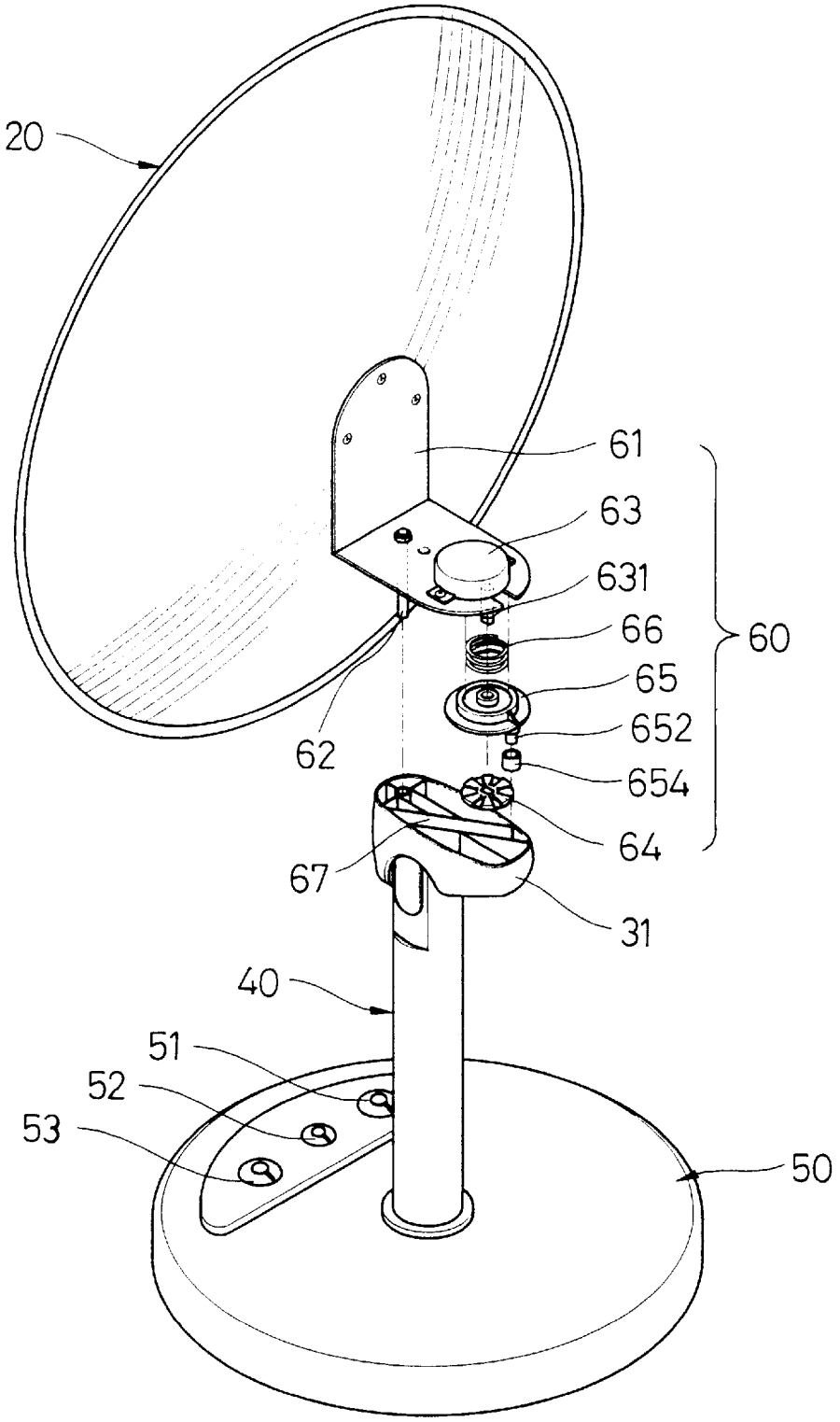
FIG. 2 is a perspective view, partly disassembled, of an electric heater with a rotating device according to a preferred embodiment of the present invention.

The present invention will be described in detail hereinafter with reference to the accompanying drawings, wherein the same reference numerals designate the same parts. It is to be understood that these drawings depict only a typical embodiment of the invention and are, therefore, not to be considered limiting its scope.

A heating element, which is indicated generally by the reference numeral 10, includes a ceramic tube 11 and an electric heating wire 12 wound on the ceramic tube 11.

The heating element 10 is mounted on the front central portion of a spherical reflector 20. The reflector 20 is arranged on the upper end portion of a post 40 so that the inclination of the reflector 20 may be adjusted by a head 30 mounted at the rear part of the reflector plate 20.

The post 40 is mounted on a stand 50, which generally includes an on-off switch 51 for the heating wire 12, a reciprocating switch 52 for the reflector 20 and a timer 53 for setting heating time.

The head 30 includes a body case 31 pivotally mounted on the upper end portion of the post 40 by a usual inclination adjuster of the reflector 20 and a over 32, which is coupled to the upper portion of the body case 31. The head 30 further includes a orientation device 60 inside the head 30 for enabling lateral reciprocating rotation of the reflector 20 within an angle of a predetermined range.

The orientation device 60 includes an L-shaped movable plate 61, a vertical portion of which is fastened at the rear central portion of the reflector 20; a pole or spindle 62 for allowing a front portion of the horizontal portion of the movable plate 61 to be pivotally mounted on the body case 31; a geared motor 63 fixed on the rear upper surface of the horizontal portion of the movable plate 61; a transmission plate 64 fixed to the lower end of a motor shaft 631 which pierces through the horizontal portion of the movable plate 61 and is exposed downward; a driving plate 65 carrying a guide pin 652 at its edge and formed with a circular concave 651 at the center of its bottom side for receiving the transmission plate by therein; a elastic spring 66 mounted around the motor shaft 631 between the horizontal portion of the movable plate 61 and the plate 65 and for allowing the driving plate 65 to rotate with the transmission plate 64 by elastically pressing the driving plate 65 toward the transmission plate 64; and an elongate guide path 67 obliquely formed inside the upper portion of the body case 31 for receiving the guide pin 652 and allowing the pin 652 to reciprocate straightly therein.

A plurality of mating teeth 641 and 653 are formed on the upper surface of the transmission plate 64 and the surface of the circular concave of the driving plate 65 respectively to be engaged with each other.

The driving plate 65 engages the transmission plate 64 at the influence of the downward elasticity of the spring 66 and by the engagement of the teeth 641 and 653 and thus rotates simultaneously with the transmission plate 64.

However, if the downward elastic power of the spring 66 is prevented to work the engagement of the driving plate 65 with the transmission pate 64 becomes loose, resulting in an idle rotation of the transmission plate 64 without making the driving plate 65 to rotate.

The electric heater according to the preferred embodiment of the present invention operates as follows:

First, when a user turns on a switch 51 to operate the heating element 10, the electric heater is supplied with power and the heating wire 12 generates heat.

The user may limit the heating time by manipulating a timer 53. If the user bends the reflector 20 or the head 30 upward or downward, the direction of the heat radiation of the reflector 20 is adjusted by the operation of the inclination adjuster 41.

Furthermore, when the user turns on the reciprocating switch 52, the reflector 20 continuously performs the lateral reciprocating movement.

When the geared motor 63 is supplied with power, the motor shaft 631 is rotated by the operation of the motor so that the transmission plate 64 mounted on the lower end of the motor shaft 631 may be rotated.

Figure 3:
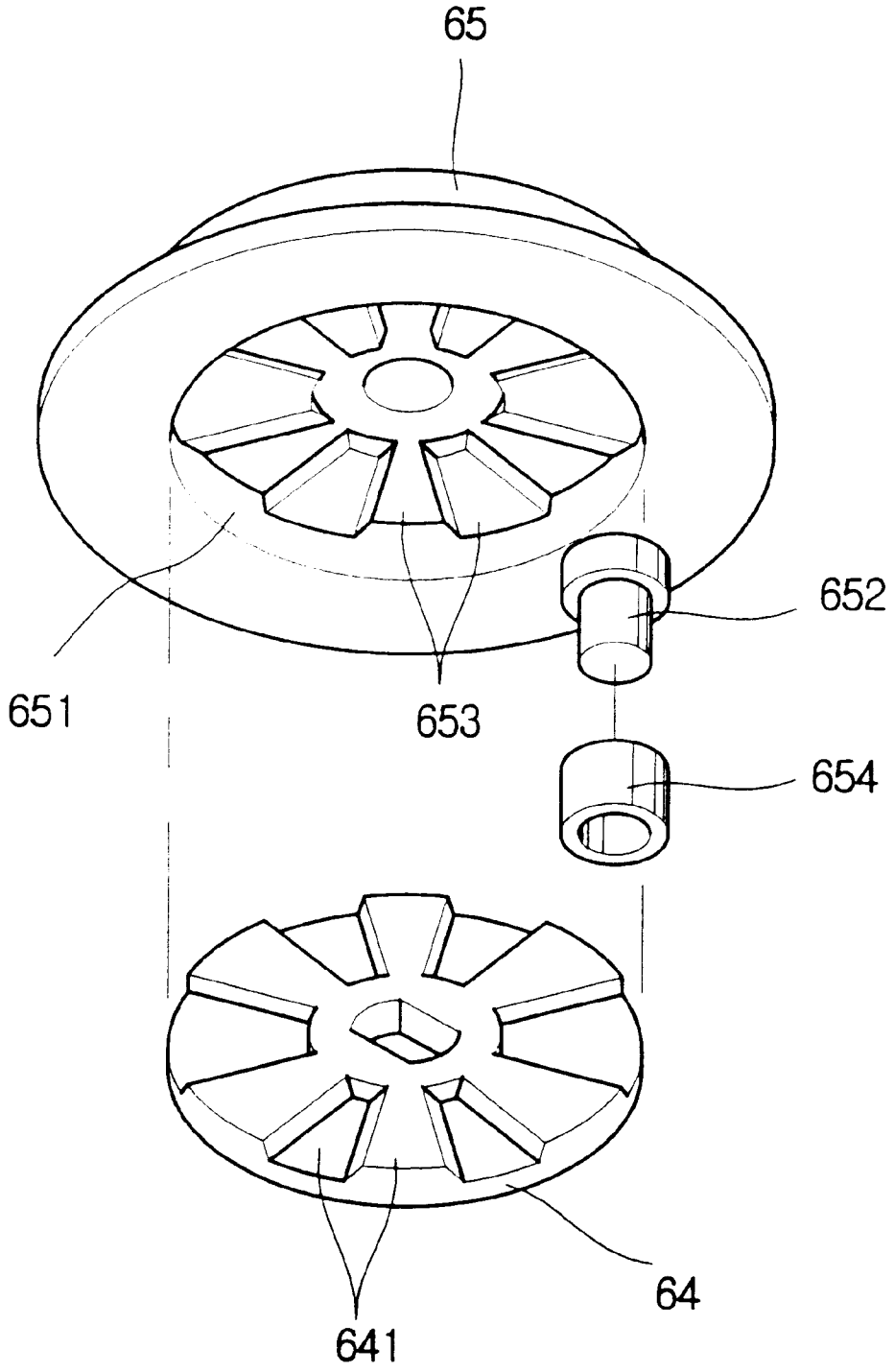
FIG. 3 is an exploded perspective view of a driving plate and a transmission plate of the orientation device of FIG. 2.
Figure 4A:
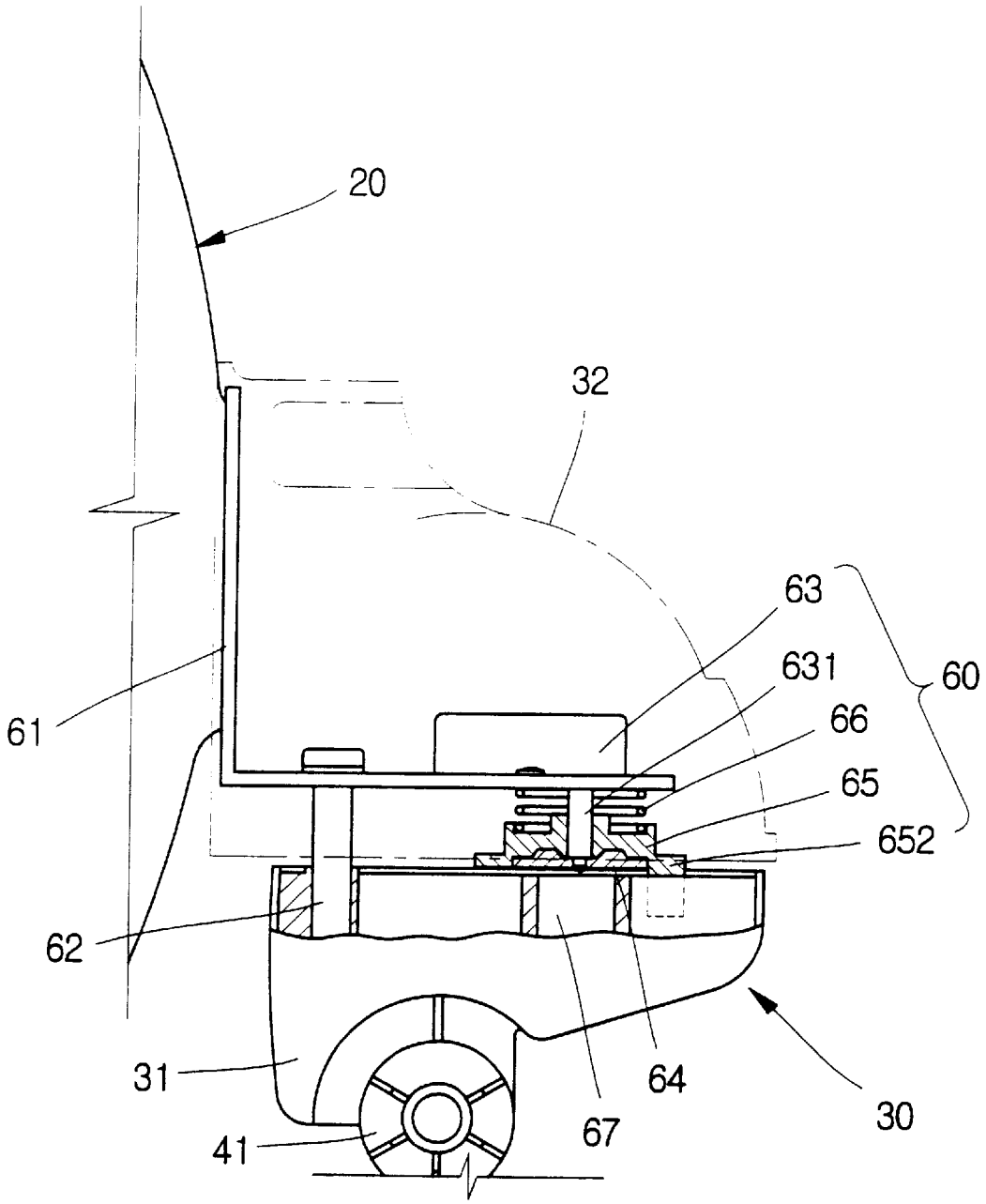
FIGS. 4*a* and 4*b* are side views partly taken in section showing the operation of the orientation device of FIG. 2.
Figure 4B:
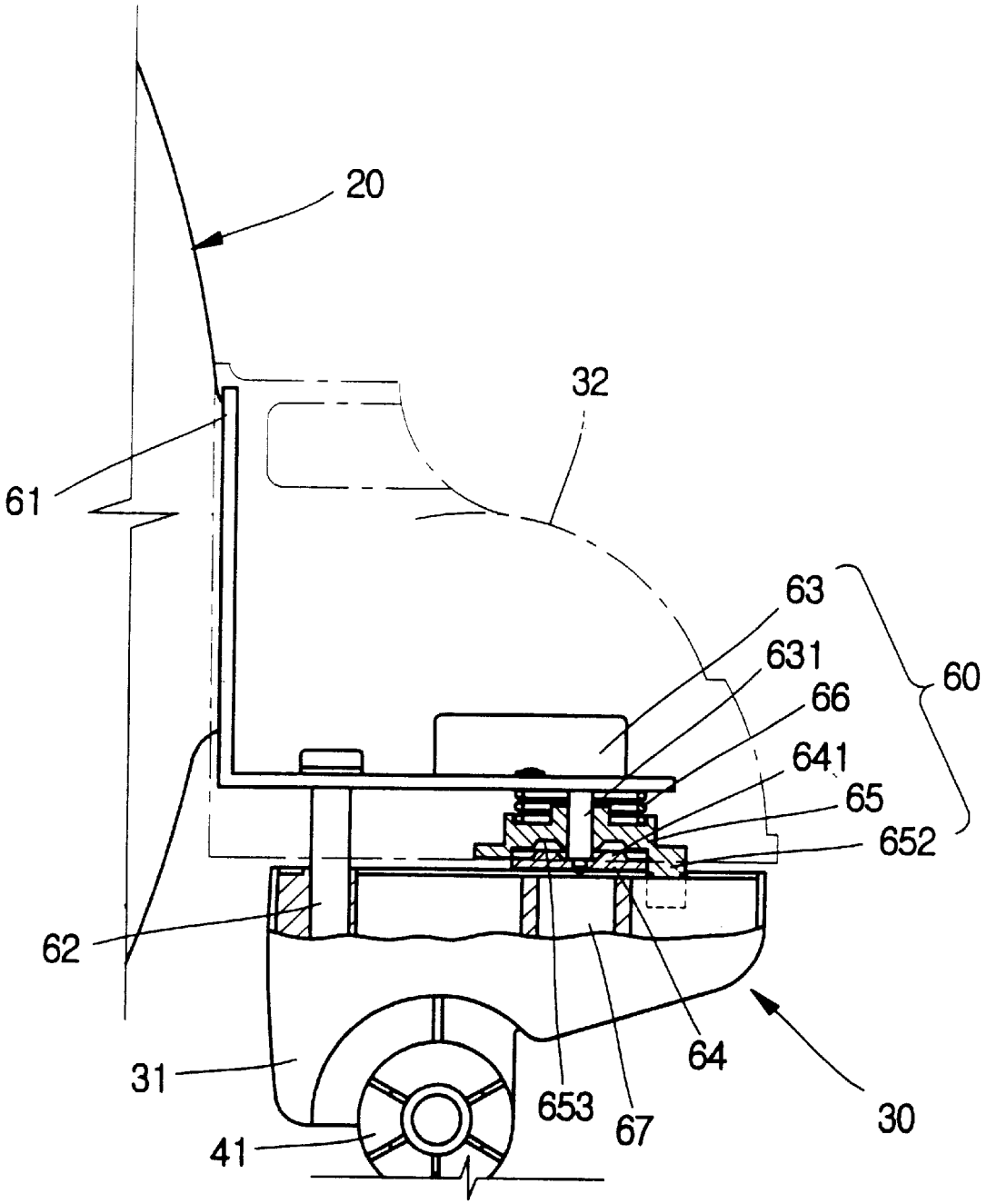

As shown in FIG. 3, since the transmission plate 64 is received in the circular concave 651 of the driving plate 65 lowered by the elasticity of the spring 66, the rotating power of the motor 63 is transmitted to the driving plate 65 by the elasticity of the spring and the engagement of the teeth 641 and 653, resulting in rotation of the driving plate 65.

When the driving plate 65 is rotated, the guide pin 652 protruded downward from the lower surface and inserted into the guide path 67 obliquely formed on the body case 31, is not moved in the rotational direction of the driving plate 65, but moved in the oblique direction along the guide path 67.

Therefore, the rotating motion of the motor 63 is converted into a rectilinear movement of the guide pin 652 through the guide path 67, and thereby the guide pin 652 is reciprocated along the guide path 67 on a same cycle as the driving plate 65 rotates. The guide pin 652 can manage to move smoothly by virtue of a ring 654 mounted thereon.

Figure 5A:
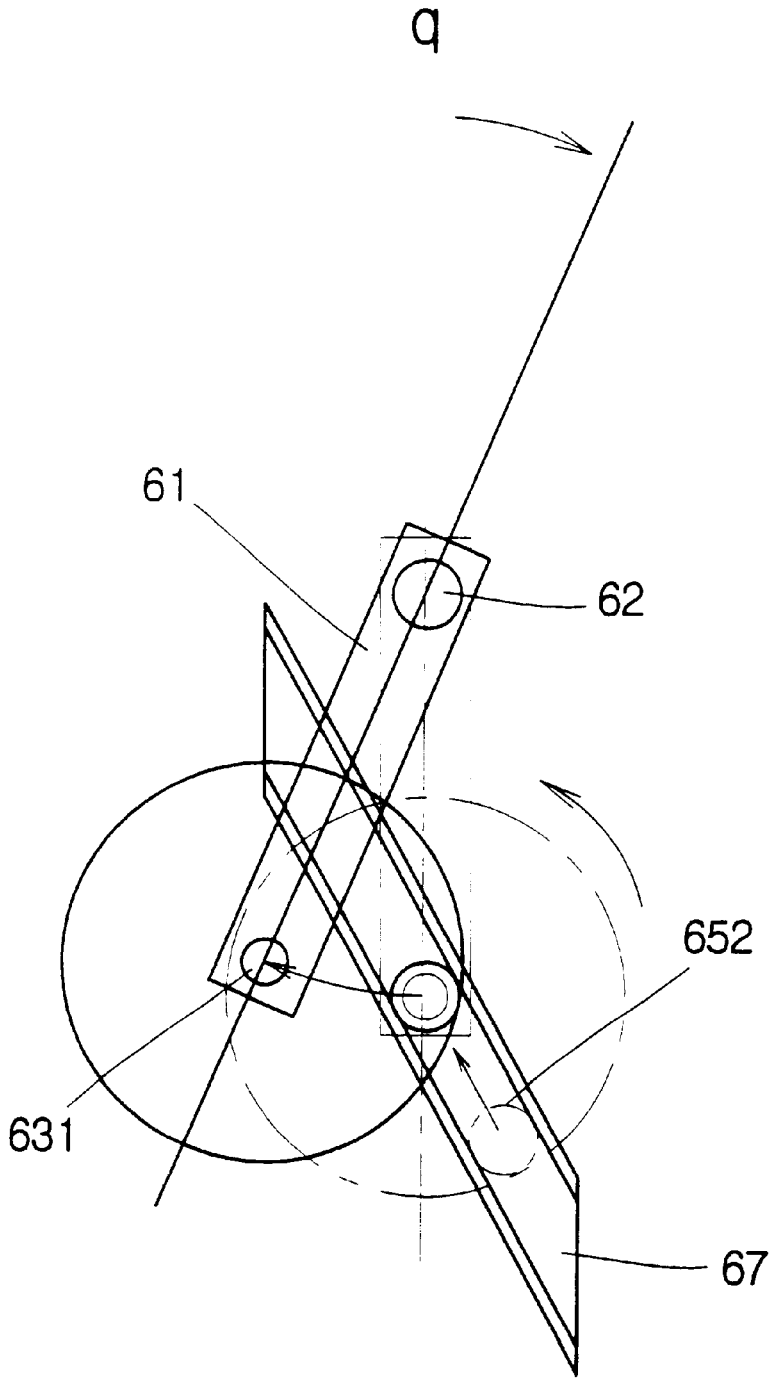
FIGS. 5*a* through 5*c* are plan views, partly taken in section, showing the operation of the parts of the orientation device.

Because the guide pin 652 moves rectilinearly while the driving plate 65 rotates, the motor shaft 631 revolves around the axis of the guide pin 652, thereby the rear part of the horizontal portion of the movable plate 61 on which the motor shaft 631 is arranged rotates in the same direction as the revolution of the motor shaft 631. Thus, as shown in FIG. 5*c* and the FIG. 6, the reflector 20 mounted on the vertical portion of the movable plate 61 reciprocates between the extreme points in the right and left. The motor shaft 631 and the pole 62 are aligned on the center line(q) and thus the reflector 20 faces the front, when the guide pin 652 is located in the rear part of the guide path 67.

In this state, as the guide pin 652 is moved to the central part of the guide path 67 by the rotation of the driving plate 65, the motor shaft 631 is moved to the left of the pole 62. The vertical portion of the movable plate 61 is rotated clockwise on the axis of the pole 62 in the right direction, thereby the reflector 20 is pivoted to the right.

Figure 5B:
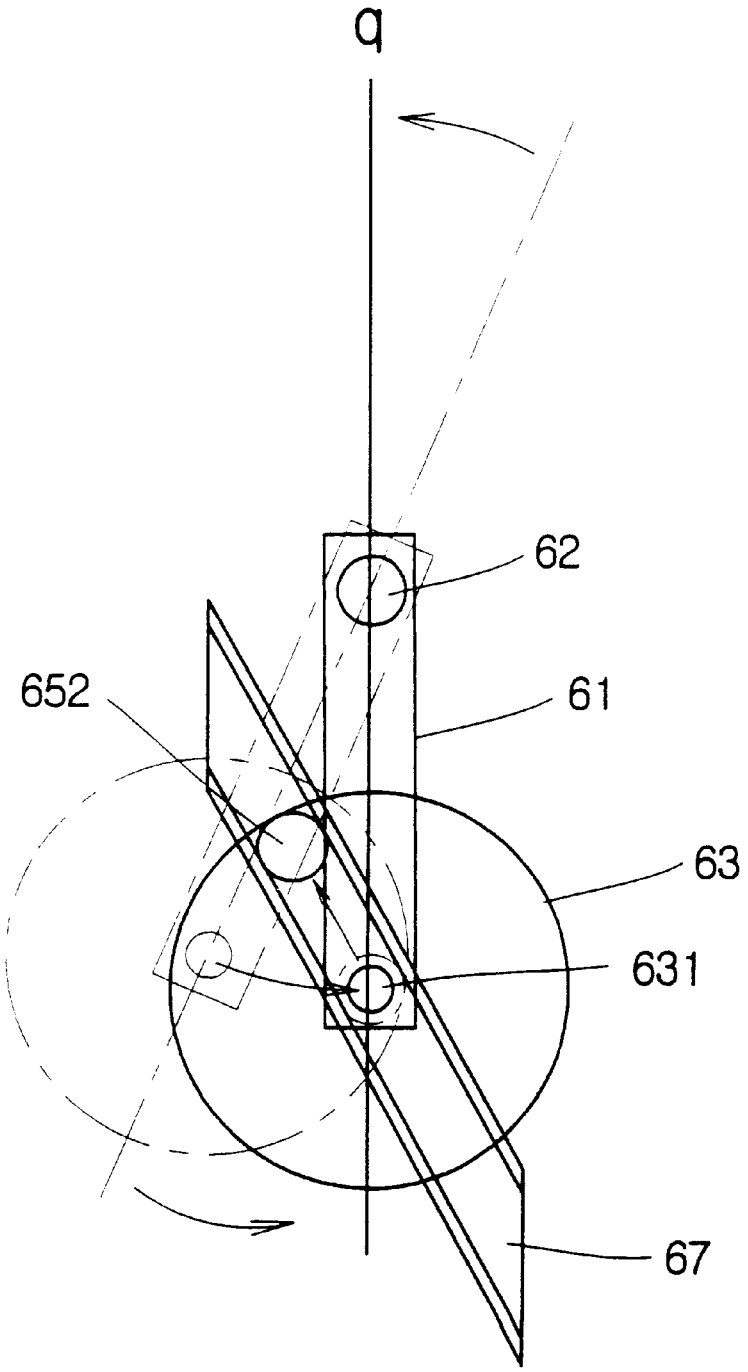
Figure 5C:
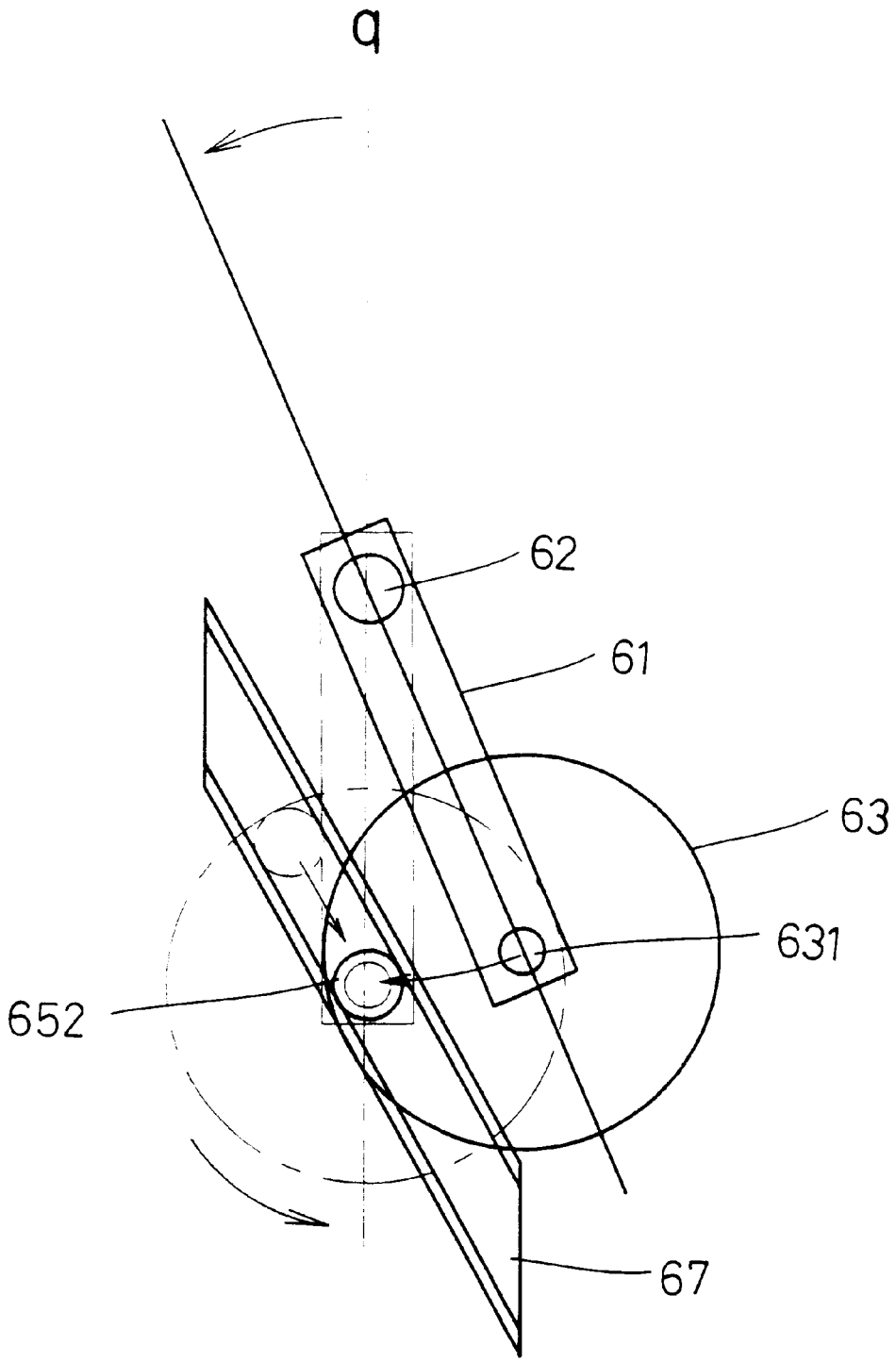
Figure 6:
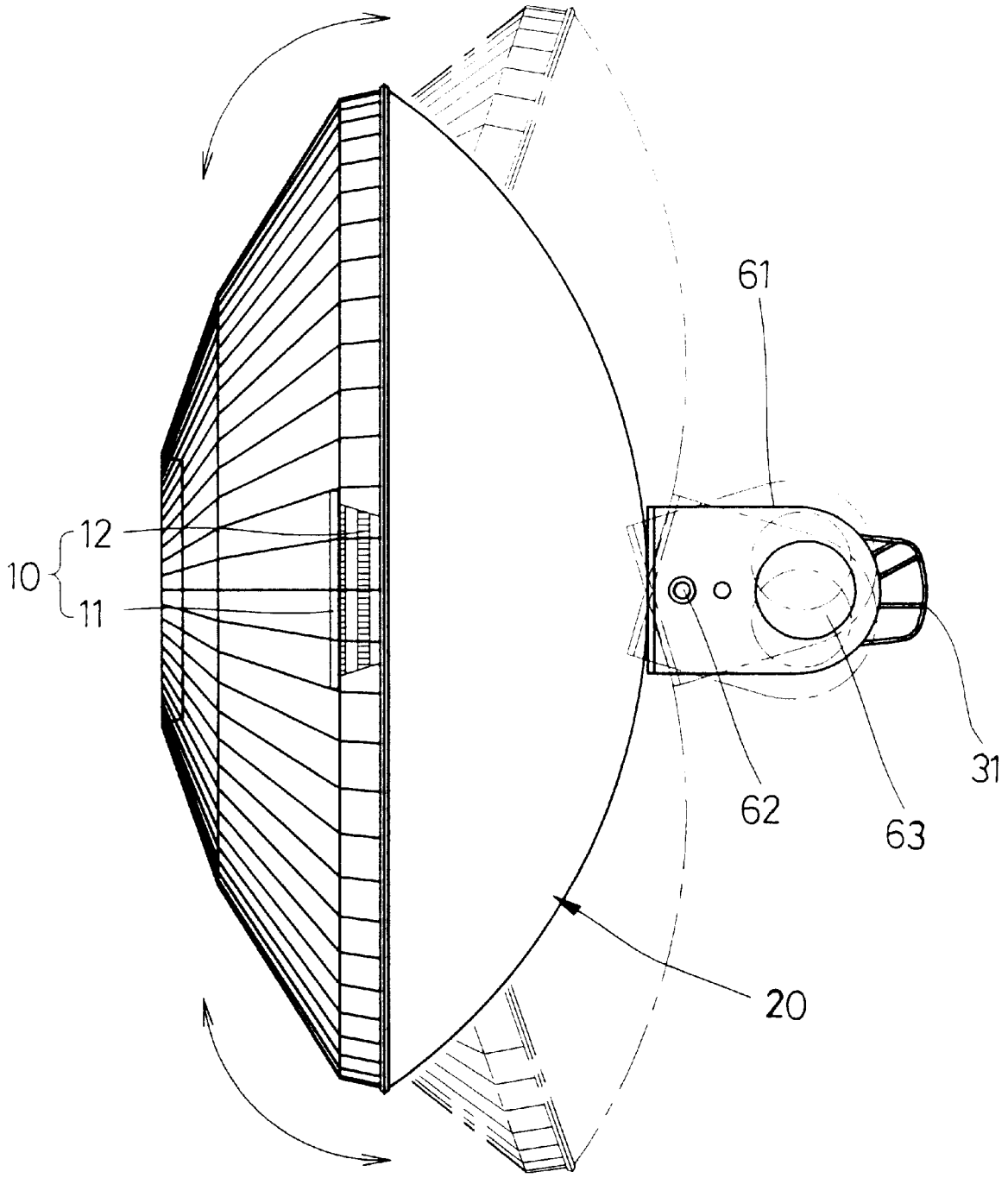
FIG. 6 is a plan view, partly taken in section, showing the lateral movement of the reflector.

After that, as the guide pin 652 is moved from the central portion to the front portion of the guide path 67 by the continuous rotation of the driving plate 65, the motor shaft 631 is moved and located on the central line(q) to be aligned with the pole 62 as shown in FIG. 5*b* and FIG. 6, thereby the reflector 20 is pivoted to the front.

When the guide pin 652 returns from the front portion to the central portion of the guide path 67 by the continuous rotation of the driving plate 65, the motor shaft 631 is moved counterclockwise as shown in FIG. 5*c*. As the front portion of the movable plate 61 is rotated counterclockwise, the reflector 20 is pivoted to the left.

When the guide pin 652 is moved from the central portion to the rear portion of the guide path 67 by the continuous rotation of the driving plate 65, the motor shaft 631 is moved and aligned with the center line(q) and the pole 62 so that the reflector 20 may be moved clockwise and face the front, whereby returning to the position as shown in FIG. 5*a*.

By the above operation, the reflector 20 reciprocates once between the extreme positions in the right and left, as the driving plate 65 is rotated once by the motor 63, thereby resulting in automatic reversing of the heat radiating direction.

Meanwhile, if the user holds the reflector with the hand during its lateral rotation or rotation of the reflector is blocked by some other means, the movable plate 61 carrying the reflector 20 cannot rotate, but the transmission plate 64 is forced to keep rotating by the motor 63, whereby the driving plate 65 can not rotate and thus the guide pin 652 cannot move inside the guide path 67.

As the transmission plate 64 is forced to keep rotating by the motor 63, the rotating power of the motor 63 acts to break the mating engagement of the clutch teeth 641 and 653 of the transmission plate 64 and the driving plate 65. As the rotating power of the motor 63 exceeds or overpowers the elasticity of the spring 66, the teeth 641 and 653 are forced to be disengaged as shown in FIG. 3*b*. The driving plate is thus pushed up in proportion to the height or depth of the teeth 641 or 653, making the spring 66 compressed and thus the transmission pin 64 keep rotating with the teeth 641 and 653 alternating between being engaged and disengaged. Therefore, the reciprocating device 60 including the motor is protected from being damaged. The reflector can also be manually pivoted on the pole 62, even when the motor 63 is operating.

As described above, the user can automatically and easily convert the direction of heat reflection of the reflector, thereby achieving the objects of the invention.

Those skilled in the art will readily recognize that various revisions, modifications and changes may be made to the present invention which has been described by way of example without departing from the spirit and scope of the present invention. The scope of the protection of the invention may be limited only by the appended claims.

What is claimed is:

1. An electric heater with a post and a heating member; which comprises an orientation device comprising a pole or spindle fixed on said post; a movable plate formed with front and rear holes and rotatably mounted on said pole or spindle through the front hole, carrying said member; a geared motor with a shaft extending downwardly through the rear hole of said movable plate; a transmission plate formed with mating teeth on the upper surface and rotatably fixed to the lower end of said motor shaft; a driving plate carrying a guide pin on or near its lower edge and formed with mating teeth on its bottom surface to be engaged with the counter part of said transmission plate; a spring mounted around said motor shaft under said movable plate for elastically pressing said driving plate downwardly; and an elongate guide path formed on said post for receiving said guide pin and allowing it to reciprocate straightly therein.

2. An electric heater as claimed in claim 1, wherein said mating teeth of said driving plate are formed in a groove on the bottom surface of said driving plate for receiving said transmission plate.

3. An electric heater as claimed in claim 1, wherein said elongate guide path is formed obliquely relative to said pole or spindle.

* * * * *